US010497307B2

(12) United States Patent
Yan

(10) Patent No.: US 10,497,307 B2
(45) Date of Patent: Dec. 3, 2019

(54) DRIVING METHOD FOR AMOLED DISPLAY AND SYSTEM THEREOF

(71) Applicant: Wuhan China Star Optoelectronics Technology Co., Ltd., Wuhan, Hubei (CN)

(72) Inventor: Weinan Yan, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 37 days.

(21) Appl. No.: 15/743,438

(22) PCT Filed: Dec. 15, 2017

(86) PCT No.: PCT/CN2017/116411

§ 371 (c)(1),
(2) Date: Jan. 10, 2018

(87) PCT Pub. No.: WO2019/033650

PCT Pub. Date: Feb. 21, 2019

(65) Prior Publication Data

US 2019/0057644 A1 Feb. 21, 2019

(30) Foreign Application Priority Data

Aug. 17, 2017 (CN) ..... 2017 1 0707445

(51) Int. Cl.
*G09G 3/20* (2006.01)
*G09G 3/3225* (2016.01)

(52) U.S. Cl.
CPC ..... *G09G 3/3225* (2013.01); *G09G 3/2007* (2013.01); *G09G 2320/0673* (2013.01); *G09G 2330/023* (2013.01)

(58) Field of Classification Search
CPC ..... G09G 3/3225; G09G 3/2007; G09G 2320/0673; G09G 2330/023
See application file for complete search history.

(56) References Cited

U.S. PATENT DOCUMENTS

2017/0011692 A1* 1/2017 Lee ..... G09G 3/3233
2017/0249890 A1* 8/2017 Yoo ..... G09G 3/2074

FOREIGN PATENT DOCUMENTS

CN 106910487 6/2017
CN 106991972 7/2017

* cited by examiner

*Primary Examiner* — Towfiq Elahi
(74) *Attorney, Agent, or Firm* — Hemispere Law, PLLC; Zhigang Ma

(57) ABSTRACT

An embodiment of the present invention discloses a method for driving an AMOLED display. The method includes the following steps: dividing a display area of the display into a plurality of regions from top to bottom, each region comprising at least one row of pixels; sequentially obtaining input image signals corresponding to each region to obtain a maximum grayscale Gi in the input image signals of the region; performing mapping to all of the grayscales in the input image signals when the maximum grayscale Gi greater than a predetermined threshold, wherein grayscales 0~$G_i$ are mapped to grayscales 0~255; and adjusting output power positive voltages corresponding to the regions, to make luminance corresponding to the adjusted grayscales 0~255 the same as the luminance corresponding to the grayscales 0~Gi before the adjustment. The embodiment of the invention also discloses a corresponding system.

2 Claims, 5 Drawing Sheets

DRIVING METHOD FOR AMOLED DISPLAY AND SYSTEM THEREOF

RELATED APPLICATIONS

The present application is a National Phase of International Application Number PCT/CN2017/116411, filed Dec. 15, 2017, and claims the priority of China Application No. 201710707445.7, filed Aug. 17, 2017.

FIELD OF THE DISCLOSURE

The disclosure relates to a Thin Film Transistor, TFT technical field, and more particularly to a driving method for an AMOLED display and a system thereof.

BACKGROUND

Comparing with the exiting LCD display technology, active-matrix organic light-emitting diode (AMOLED) display technology does not need a backlight, directly driven organic materials to emit light by current, therefore can be fabricated slimmer, the viewing angle is larger, and can significantly save energy. In addition, it also has the advantages of fast response, color saturation is more full, higher luminance, high temperature resistance, etc. Therefore, AMOLED display technology is recognized by the industry as a new generation of display technology after the LCD. At present, AMOLED display has been more and more used in television, mobile phones, car use, wear and other display areas.

However, in the conventional technology, how to increase the working efficiency of the PMIC, and how to achieve further energy saving and power saving is a problem worth studying.

SUMMARY

The technical problem to be solved by the present invention is to provide a driving method for an AMOLED display and a system thereof, to reduce the cross-voltage of the AMOLED, and improve the working efficiency of the PMIC, so as to realize further energy saving and power saving.

In order to solve the above technical problem, an aspect of an embodiment of the present invention provides a driving method for an AMOLED display, including the following steps:

Dividing a display area of the display into a plurality of regions from top to bottom, each region including at least one row of pixels;

Sequentially obtaining input image signals corresponding to each region to obtain a maximum grayscale Gi in the input image signals of the region;

Performing mapping to all of the grayscales in the input image signals when the maximum grayscale Gi greater than a predetermined threshold, wherein grayscales 0~$G_i$ are mapped to grayscales 0~255; and Adjusting output power positive voltages corresponding to the region, to make luminance corresponding to the adjusted grayscales 0~255 the same as the luminance corresponding to the grayscales 0~Gi before the adjustment.

Wherein the step of performing mapping to all grayscales in the input image signals when the maximum grayscale Gi greater than a predetermined threshold, and mapping grayscales 0~Gi to grayscales 0~255 specifically includes:

Calculating to obtain a mapped grayscale G'x of each grayscale Gx according to the following formula:

$$G'x = \frac{Gx}{Gi} \cdot 255$$

Wherein, the grayscale Gx is between the grayscales 0~Gi.

Wherein the step of adjusting the output power positive voltages corresponding to the region, to make luminance corresponding to the adjusted grayscales 0~255 the same as the luminance corresponding to the grayscales 0~Gi before the adjustment specifically includes:

Obtaining the adjusted output power positive voltage of a current region by the following formula:

$$OVDD' = OVDD - (V_{Gi} - V_{255})$$

Wherein OVDD' is the adjusted output power positive voltage of the current region, OVDD is the original output power positive voltage of the current region, $V_{Gi}$ is the original output power positive voltage corresponding to the grayscale Gi, $V_{255}$ is the original output power positive voltage corresponding to the grayscale 255; and Controlling to output the obtained adjusted output power positive voltage to the current region of the display panel.

Correspondingly, in another aspect of the embodiments of the present invention, a driving system of an AMOLED display is further provided, including a driver IC module, a GAMMA voltage driving module, a PMIC module, a display panel, and a data input unit, wherein the driver IC module includes:

A dividing unit configured to divide a display area of a display panel into a plurality of regions from top to bottom, each region at least including one row of pixels;

A maximum grayscale obtaining unit configured to sequentially obtaining input image signals corresponding to each region from the data input unit, and obtaining a maximum grayscale $G_i$ in the input image signal of the region;

A grayscale mapping unit configured to perform mapping to all of the grayscales in the input image signal, when the maximum grayscale $G_i$ greater than a predetermined threshold, wherein grayscales 0~$G_i$ is mapped to grayscales 0~255; and An adjustment control unit configured to adjust output power positive voltages corresponding to the region, to make luminance corresponding to the adjusted grayscales 0~255 the same as the luminance corresponding to the grayscales 0~Gi before the adjustment.

Wherein grayscale mapping unit includes:

A calculation unit configured to obtain a mapped grayscale G'x of each grayscale Gx according to the following formula;

$$G'x = \frac{Gx}{Gi} \cdot 255$$

Wherein, the grayscale Gx is between the grayscales 0~Gi.

Wherein the adjustment control unit includes:

An adjustment voltage obtaining unit configured to obtaining the adjusted output power positive voltage of a current region by the following formula;

$$OVDD' = OVDD - (V_{Gi} - V_{255})$$

Wherein OVDD' is the adjusted output power positive voltage of the current region, OVDD is the original output power positive voltage of the current region, $V_{Gi}$ is the original output power positive voltage corresponding to the grayscale Gi, $V_{255}$ is the original output power positive voltage corresponding to the grayscale 255; and An adjusting unit configured to control outputting the obtained adjusted output power positive voltage to the current region of the display panel.

The implementation of the embodiments of the present invention has the following beneficial effects:

In the embodiment of the present invention, the image is obtained from the input signal unit by the driver IC module, when the maximum grayscale G in the image is greater than a predetermined threshold, all the grayscales in the input image signal are mapped, the grayscales 0~$G_i$ is mapped to the grayscales 0~255, while controlling the PMIC module to reduce the OVDD at the same time, and adjust the GAMMA voltage, so that the luminance corresponding to the adjusted grayscale is the same as the luminance corresponding to the grayscale before the adjustment; because the output voltage OVDD is reduced, while the working efficiently of the PMIC module is increased with a lower cross-voltage of the OVDD-OVSS, the power saving effect can be achieved without changing the luminance of the panel.

BRIEF DESCRIPTION OF THE DRAWINGS

To describe the technical solutions in the embodiments of the present invention or in the conventional technology more clearly, the following briefly introduces the accompanying drawings required for describing the embodiments or the conventional technology. Apparently, the accompanying drawings in the following description merely show some embodiments of the present invention. For those skilled in the art, other drawings may be obtained based on these drawings without any creative work.

DETAILED DESCRIPTION OF PREFERRED EMBODIMENTS

Figure 1:
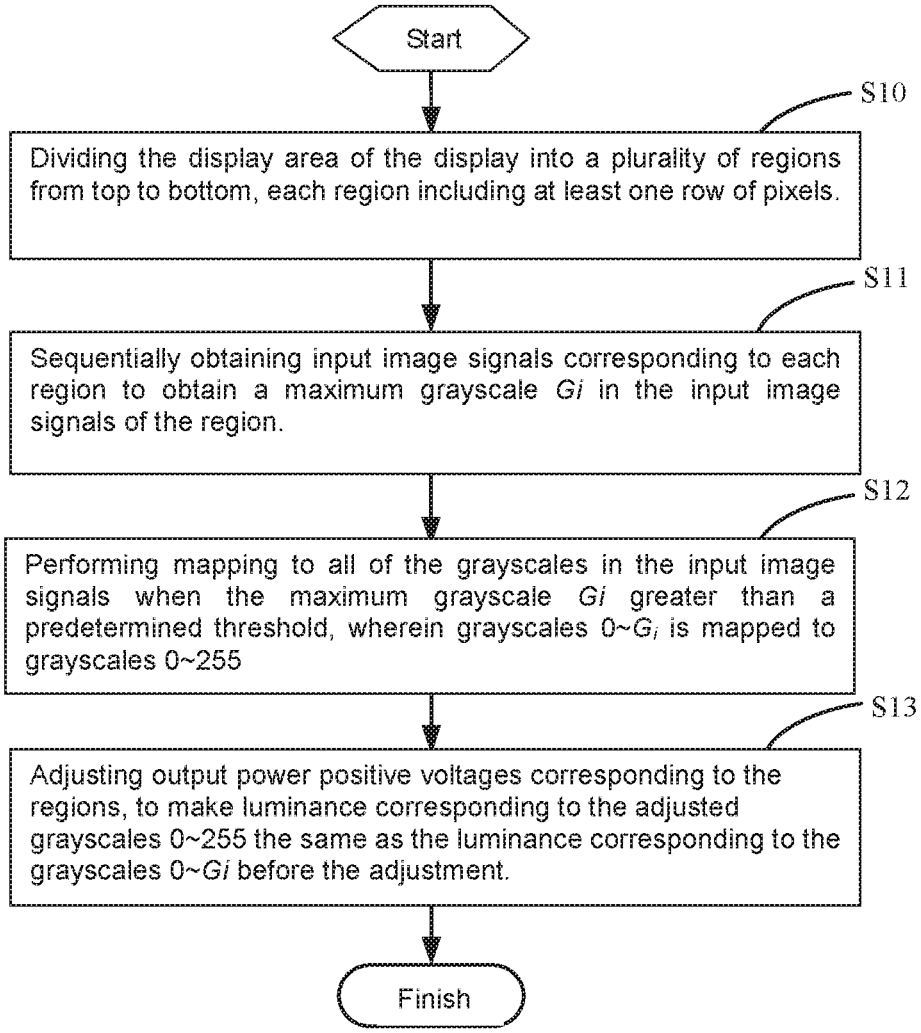
FIG. 1 is a main flow diagram of a driving method for an AMOLED display according an embodiment of the present invention.

The technical solutions in the embodiments of the present invention will be described clearly and completely below with reference to the accompanying drawings in the embodiments of the present invention. Apparently, the described embodiments are merely some but not all embodiments of the present invention. All other embodiments obtained by a person of ordinary skill in the art based on the embodiments of the present invention without creative efforts shall fall within the protection scope of the present invention.

In addition, the following description of the embodiments is given with reference to the appended drawings, for the purpose of illustrating certain embodiments in which the invention may be practiced. Directional terms such as "up", "down", "front", "back", "left", "right", "inside", "outside", "side" is used to refer to the attached drawings. Therefore, the directional terms are used for better and more clearly illustrating and understanding the present invention, rather than indicating or implying that the device or element must have a specific orientation structure and operation, and thus cannot be understood as a limitation of the present invention.

In the description of the present invention, it should be noted that the terms "mounted," "linked," and "connected" should be broadly understood unless the context clearly indicates otherwise. For example, may be fixed connection or may be removable connected, or integrally connected, may be a mechanical connection, either directly or indirectly through an intermediary, and may be internal connections of two components. For those skilled in the art, the specific meanings of the above terms in the present invention may be understood based on specific cases.

In addition, in the description of the present invention, unless otherwise specified, the meaning of "plural" is two or more. The phrase "process" appearing in this specification means not only an independent process, but also a term that is intended to achieve the intended function of the process when it cannot be clearly distinguished from other processes. The numerical range denoted by "~" in the present specification means a range including the numerical values described before and after "~" as the minimum value and the maximum value, respectively. In the drawings, the structures that are similar or the same are denoted by the same reference numerals.

Referring to FIG. 1, a main flow diagram of a driving method for an AMOLED display according an embodiment of the present invention is shown. Please also refer to FIG. 2 to FIG. 4 together. In this embodiment, the driving method for the AMOLED display includes the following steps:

Step S10, dividing the display area of the display into a plurality of regions from top to bottom, each region including at least one row of pixels;

Step S11, sequentially obtaining input image signals corresponding to each region to obtain a maximum grayscale Gi in the input image signals of the region;

Step S12: performing mapping to all of the grayscales in the input image signals when the maximum grayscale Gi greater than a predetermined threshold, wherein grayscales 0~$G_i$ is mapped to grayscales 0~255;

In an example, the step S12 is specifically as following: calculating to obtain a mapped grayscale G'x of each grayscale Gx according to the following formula:

$$G'x = \frac{Gx}{Gi} \cdot 255$$

Wherein, the grayscale Gx is between the grayscales 0~Gi.

Step S13: adjusting an output power positive voltage corresponding to the region, to make luminance corresponding to the adjusted grayscales 0~255 the same as the luminance corresponding to the grayscales 0~Gi before the adjustment.

In an embodiment, the step S13 includes:

Obtaining the adjusted output power positive voltage of the current region by the following formula:

$$OVDD' = OVDD - (V_{Gi} - V_{255})$$

Wherein OVDD' is the adjusted output power positive voltage of the current region, OVDD is the original output power positive voltage of the current region, $V_{Gi}$ is the original output power positive voltage corresponding to the grayscale Gi, $V_{255}$ is the original output power positive voltage corresponding to the grayscale 255.

For controlling to output the obtained adjusted output power positive voltage to the current region of the display panel.

For ease of understanding, the working principle of the present invention and the sources of the two formulas in step S12 and step S13 will be further described below with reference to FIG. 2 to FIG. 4.

Figure 2:
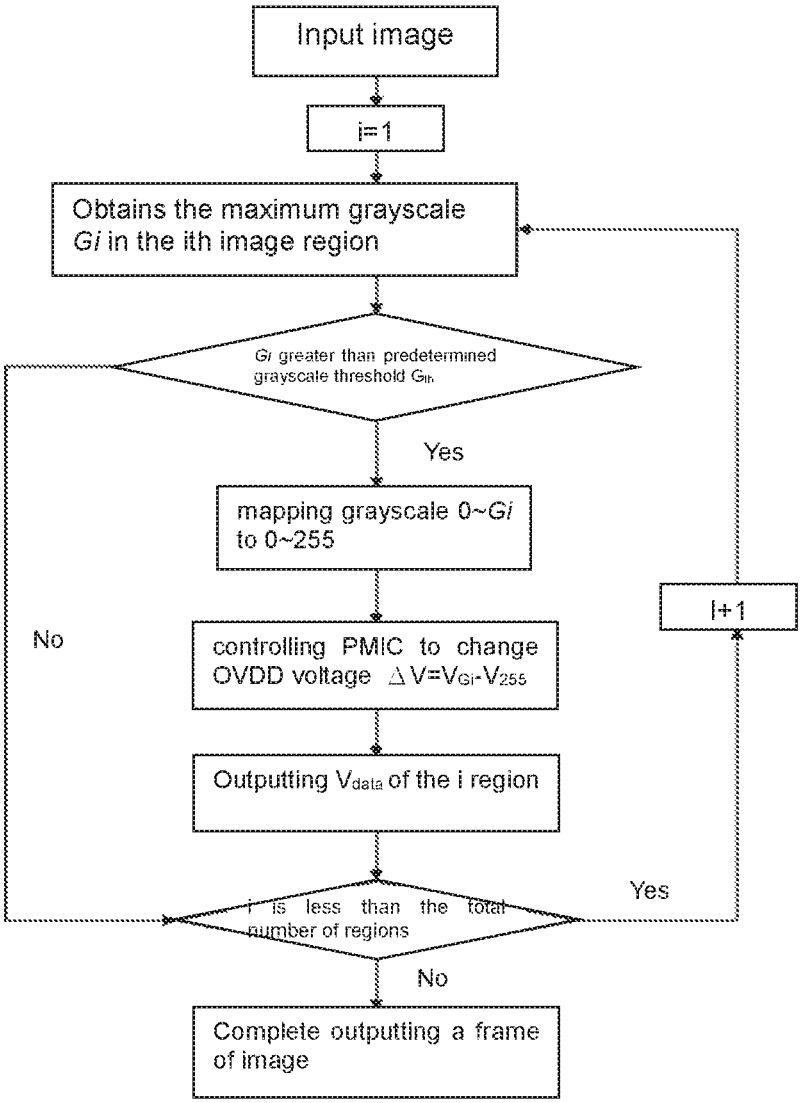
FIG. 2 is a more detailed flow diagram corresponding to FIG. 1.

FIG. 2 shows the more detailed workflow of the present invention. When the image is inputted, the image is divided into a plurality of regions (referring to FIG. the driver IC module of the AMOLED display obtains the maximum grayscale Gi in the ith image region. In order to prevent the situation that the cross voltage (OVDD-OVSS) of the AMOLED device is too small causing cannot work normally, wherein OVSS is the output power negative voltage, when Gi is less than the predetermined grayscale threshold $G_{th}$, a buck operation is not performed. When $Gi>G_{th}$, the grayscales 0~Gi is mapping to 0~255, the specific mapping process can be described in conjunction with FIG. 4 as follows:

(1) Mapping the grayscale Gi to 255:

Gi→255

Figure 4:
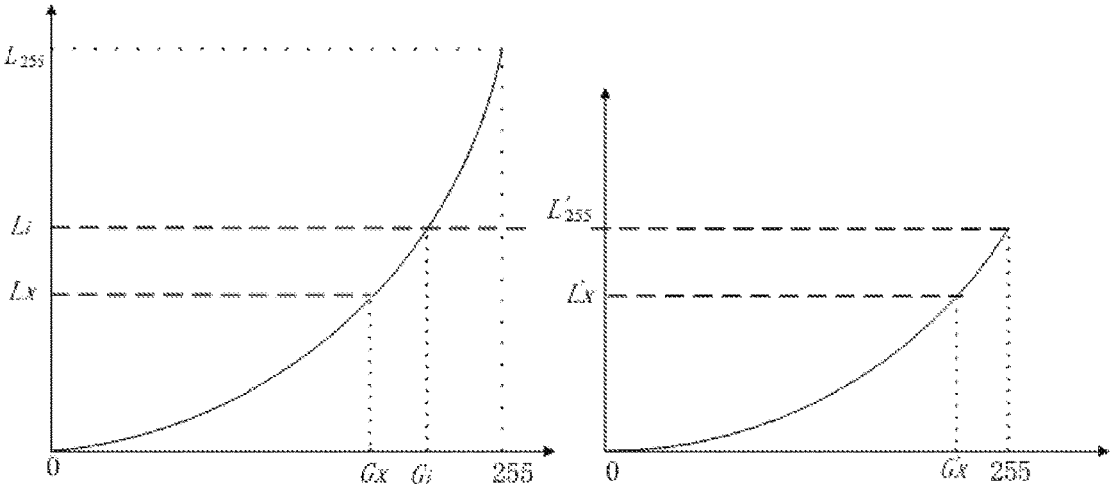
FIG. 4 is a schematic diagram of grayscale mapping in FIG. 1.

Wherein, in the two illustrations in FIG. 4, the left illustration corresponds to the information before mapping, the right illustration corresponds to the information after mapping, the ordinate is the luminance value, and the abscissa is the grayscale.

(2) The luminance is not changed before and after the mapping, so:

$$Li = L_{255} \cdot \left(\frac{Gi}{255}\right)^{2.2} = L'_{255}$$

Wherein, $V_{255}$ is the luminance corresponding to the grayscale 255 before the mapping; $L'_{255}$ is the maximum luminance corresponding to the grayscale 255 after the mapping; it can be understood that, 2.2 in the formula is the GAMMA index of the embodiment herein; and in other embodiments, other values can be adopted.

(3) $L'_{255}$ is the maximum luminance after the mapping, for the grayscale Gx lower than Gi before the mapping, the luminance $L_x$ is:

$$Lx = L_{255} \cdot \left(\frac{Gx}{255}\right)^{2.2} = L'_{255} \cdot \left(\frac{G'x}{255}\right)^{2.2}$$

(4) Combining the two formulas, the grayscale after the mapping is obtained:

$$G'x = \frac{Gx}{Gi} \cdot 255$$

Wherein, for the pixel circuit after the compensation, the relationship of the current flowing through the AMOLED and voltage is as follows:

$$I_{OLED}=k(\text{OVDD}-V_{data})^2$$

Wherein, $V_{data}$ is the voltage value corresponding to a certain image data; and k is a fixed coefficient value; when $V_{data}$ is changed from $V_{Gi}$ to $V_{255}$, in order to keep $I_{OLED}$ unchanged, so as OVDD also needs to be changed correspondingly:

$$k(\text{OVDD}-V_{Gi})^2=k(\text{OVDD}'-V_{255})^2$$

The OVDD' after the changed can be obtained as follows:

$$\text{OVDD}'=\text{OVDD}(V_{Gi}-V_{255})$$

The driver IC module in the AMOLED display provides an instruction to the PMIC module (power management IC module) to adjust the OVDD to the changed voltage, and transporting the mapped grayscale voltage to the ith region of the display panel, and then processes the data of the next region.

It can be understood that, the driver IC module in the AMOLED display obtains the image from the input signal, and obtains the maximum grayscale $G_x$ of the image at the same time. When $G_x<255$, the $G_x$ can be mapped to grayscale 255 and outputted; while controlling the PMIC to reduce OVDD, so that the luminance corresponds to the adjusted grayscale 255 is the same with the $G_x$ before adjustment. At the same time, the grayscale smaller than the $G_x$ in the original image is performed by the mapping process, to make the luminance corresponding to the original grayscale keeping unchanged. In this way, because the output voltage OVDD is reduced, while the working efficiently of the PMIC module is increased with a lower cross-voltage of the OVDD-OVSS, the power saving effect can be achieved without changing the luminance of the panel.

Figure 3:
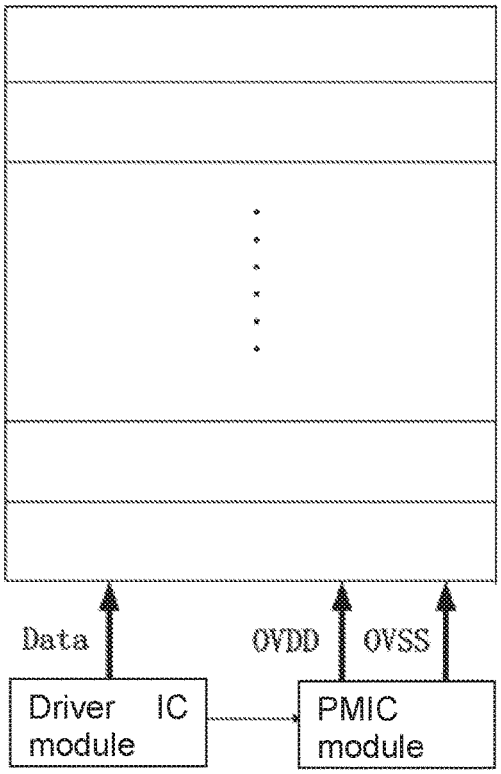
FIG. 3 is a schematic diagram of dividing a display area of the display in FIG. 1.

At the same time, the driver IC module divides the input image into a plurality of regions according to FIG. 3, so that the OVDD in each region is reduced to a different extent, to achieve maximum power saving. It can be understood that, the number of dividing regions can be determined by the response speed of the PMIC module. If the response speed of the PMIC module is faster, the more dividing regions are, and if the response speed of the PMIC module is fast enough, the OVDD of each row of pixels can be set to be different.

Figure 5:
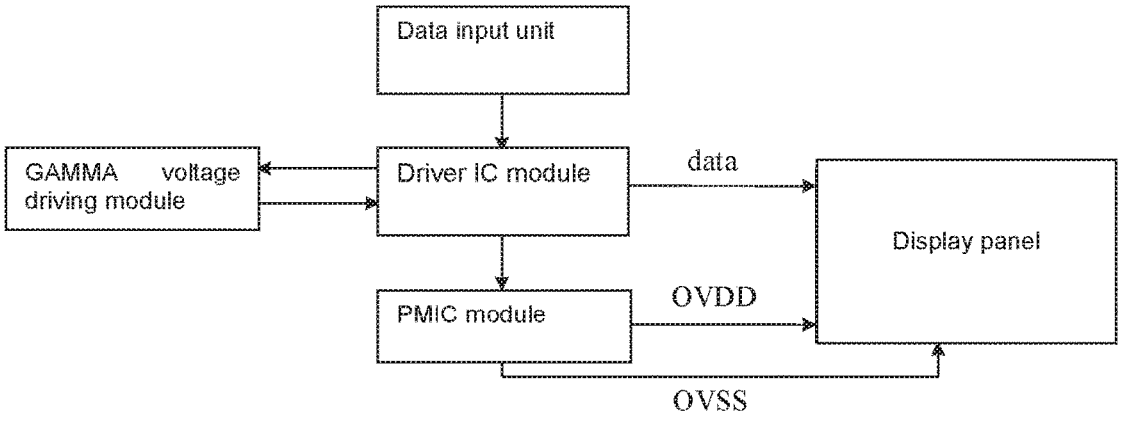
FIG. 5 is a schematic structural diagram of a driving system of an AMOLED display according an embodiment of the present invention.
Figure 6:
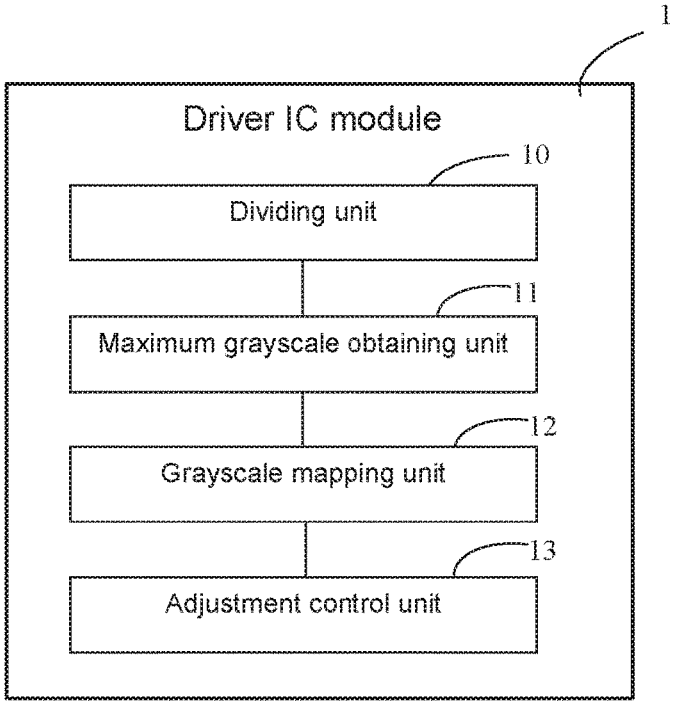
FIG. 6 is a schematic structural diagram of the drive IC module of FIG. 5.
Figure 7:
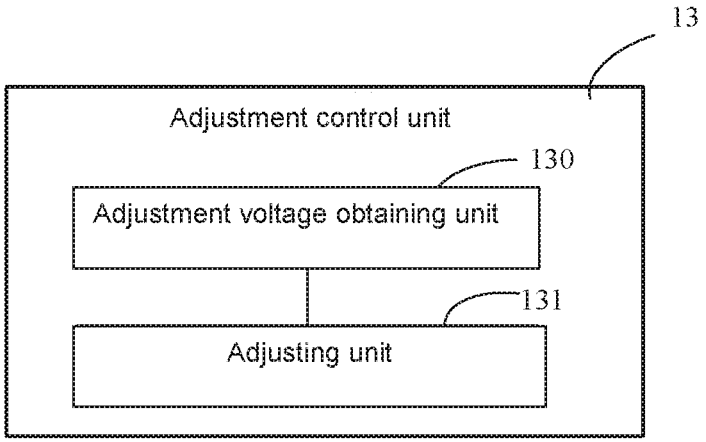
FIG. 7 is a schematic structural diagram of the adjustment control unit in FIG. 5.

Correspondingly, as shown in FIG. 5, a schematic structural diagram of a driving system of an AMOLED display according an embodiment of the present invention is shown. In conjunction with FIG. 6 to FIG. 7, in the present embodiment, the driving system of the AMOLED display includes a driver IC module, a GAMMA voltage driving module, a PMIC module, a display panel, and a data input unit, wherein the driver IC module 1 further includes:

A dividing unit 10, is configured to divide the display area of the display panel into a plurality of regions from top to bottom, each region at least including one row of pixels;

A maximum grayscale obtaining unit 11, is configured to sequentially obtaining the input image signals corresponding to each region from the data input unit, and obtaining the maximum grayscale $G_i$ in the input image signal of the region;

A grayscale mapping unit 12 is configured to perform mapping all of the grayscales in the input image signal, when the maximum grayscale $G_i$ is greater than a predetermined threshold, the grayscales 0~$G_i$ is mapping to the grayscales 0~255;

An adjustment control unit 13 is configured to adjust the output power positive voltages corresponding to the region, so that the luminance corresponding to the adjusted grayscales 0~255 is the same as the luminance corresponding to 0~$G_i$ before the adjustment.

Wherein the grayscale mapping unit 12 includes:

A calculation unit (not shown) is configured to calculate and obtain the grayscales $G'_x$ after the mapping of each grayscale $G_x$ according to the following formula:

$$G'x = \frac{Gx}{Gi} \cdot 255$$

Wherein, the grayscale $G_x$ is between the grayscales 0~$G_i$.

Wherein, the adjustment control unit 13 includes:

An adjustment voltage obtaining unit 130 is configured to obtain the adjusted output power positive voltage in the current region according to the following formula:

$$OVDD' = OVDD - (V_{Gi} - V_{255})$$

Wherein OVDD' is the adjusted output power positive voltage of the current region, OVDD is the original output power positive voltage of the current region, $V_{Gi}$ is the original output power positive voltage corresponding to the grayscale Gi, $V_{255}$ is the original output power positive voltage corresponding to the grayscale 255.

An adjusting unit 131 is configured to control the PMIC module and the GAMMA voltage driving module to output the adjusted output power positive voltage obtained by the adjustment voltage obtaining unit to the current region of the display panel.

For more details, reference may be made to the foregoing description of FIG. 1 to FIG. 4, and details are not described herein.

The implementation of the embodiments of the present invention has the following beneficial effects:

In the embodiment of the present invention, the image is obtained from the input signal unit by the driver IC module, when the maximum grayscale $G_i$ in the image is greater than a predetermined threshold, all the grayscales in the input image signal are mapped, the grayscales 0~$G_i$ is mapped to the grayscales 0~255, while controlling the PMIC module to reduce the OVDD at the same time and adjust the GAMMA voltage, so that the luminance corresponding to the adjusted grayscale is the same as the luminance corresponding to the grayscale before the adjustment; because the output voltage OVDD is reduced, while the working efficiently of the PMIC module is increased with a lower cross-voltage of the OVDD-OVSS, the power saving effect can be achieved without changing the luminance of the panel.

In the meantime, in the embodiment of the present invention, the input image may be divided into a plurality of regions, and the OVDD voltages may be respectively adjusted according to the grayscales different regions, so as to maximize the power saving effect.

Meanwhile, it can be understood that, in the embodiment of the present invention, wherein, the grayscale 255 is the maximum grayscale when the data bit width is 8 bits, when the data bit width is n bit, the corresponding maximum grayscale is $2^n-1$, the value of 255 need to be replaced by the value of $2^n-1$ in all of the formulas in this document, and the method of the present invention can also be implemented.

The foregoing contents are detailed description of the disclosure in conjunction with specific preferred embodiments and concrete embodiments of the disclosure are not limited to these descriptions. For the person skilled in the art of the disclosure, without departing from the concept of the disclosure, simple deductions or substitutions can be made and should be included in the protection scope of the application.

What is claimed is:

1. A driving method for an AMOLED display comprising the following steps:

dividing a display area of the display into a plurality of regions from top to bottom, each region comprising at least one row of pixels;

sequentially obtaining input image signals corresponding to each region to obtain a maximum grayscale Gi in the input image signals of the region;

performing mapping to all of the grayscales in the input image signals when the maximum grayscale Gi greater than a predetermined threshold, wherein grayscales 0~$G_i$ are mapped to grayscales 0~255; and adjusting output power positive voltages corresponding to the regions, to make luminance corresponding to the adjusted grayscales 0~255 the same as the luminance corresponding to the grayscales 0~Gi before the adjustment, wherein the step of adjusting output power positive voltages corresponding to the regions, to make luminance corresponding to the adjusted grayscales 0~255 the same as the luminance corresponding to the grayscales 0~Gi before the adjustment specifically comprises:

obtaining the adjusted output power positive voltage of a current region by the following formula:

$$OVDD' = OVDD - (V_{Gi} - V_{255})$$

wherein OVDD' is the adjusted output power positive voltage of the current region, OVDD is the original output power positive voltage of the current region, $V_{Gi}$ is the original output power positive voltage corresponding to the grayscale Gi, $V_{255}$ is the original output power positive voltage corresponding to the grayscale 255; and controlling to output the obtained adjusted output power positive voltage to the current region of the display panel.

2. The driving method for the AMOLED display according to claim 1, wherein the step of performing mapping to all grayscales in the input image signals when the maximum grayscale Gi greater than a predetermined threshold, and mapping grayscales 0~Gi to grayscales 0~255 specifically comprises:

calculating to obtain a mapped grayscale G 'x of each grayscale Gx according to the following formula:

$$G'x = \frac{Gx}{Gi} \cdot 255$$

wherein, the grayscale Gx is between the grayscales 0~Gi.

* * * * *